United States Patent [19]

Bernecker

[11] 4,301,096

[45] * Nov. 17, 1981

[54] DEVICE FOR SUPPLYING FUEL TO AN INTERNAL COMBUSTION ENGINE

[75] Inventor: Gunther Bernecker, Montvale, N.J.

[73] Assignee: G.M.C. Research, Inc., Orange, N.J.

[ * ] Notice: The portion of the term of this patent subsequent to Aug. 14, 1996, has been disclaimed.

[21] Appl. No.: 64,298

[22] Filed: Aug. 6, 1979

Related U.S. Application Data

[63] Continuation-in-part of Ser. No. 841,872, Oct. 13, 1977, Pat. No. 4,164,525.

[51] Int. Cl.[3] ..... F02M 29/02

[52] U.S. Cl. ..... 261/41 B; 261/50 R; 261/89; 261/64 A; 48/180 S

[58] Field of Search ..... 48/180 S; 261/50 R, 261/41 B, 89

[56] References Cited

U.S. PATENT DOCUMENTS

| | | | |
|---|---|---|---|
| 1,172,595 | 2/1916 | Heath et al. | 48/180 S |
| 2,036,431 | 4/1936 | Munch et al. | 48/180 S |
| 3,615,296 | 10/1971 | Guarnaschelli | 48/180 S |
| 3,959,418 | 5/1976 | Sullivan | 261/50 R |
| 4,011,850 | 3/1977 | Knox, Sr. | 48/180 S |
| 4,164,525 | 8/1979 | Bernecker | 261/50 R |
| 4,170,615 | 10/1979 | Kalert et al. | 261/50 R |

FOREIGN PATENT DOCUMENTS

| | | | |
|---|---|---|---|
| 2285525 | 4/1976 | Fed. Rep. of Germany | 48/180 S |

*Primary Examiner*—Tim R. Miles

*Attorney, Agent, or Firm*—Jordan and Hamburg

[57] ABSTRACT

A carburetor for supplying a fuel/air mixture to an internal combustion engine comprises fuel regulation means for controlling flow rate of the fuel in response to a motor vehicle throttle and continuously feeding the fuel to the intake manifold of the engine, air admitting means for admitting air with the ejected fuel into the intake manifold, and fuel/air admixing means including a plurality of blades rotating by suction force due to the operation of the engine. The fuel and air passing through the fuel regulation means and the air admitting means, respectively, are atomizingly admixed and are fed to the engine through the intake manifold.

3 Claims, 5 Drawing Figures

DEVICE FOR SUPPLYING FUEL TO AN INTERNAL COMBUSTION ENGINE

REFERENCE TO RELATED APPLICATION

This is a continuation-in-part of application Ser. No. 841,872 filed on Oct. 13, 1977, now U.S. Pat. No. 4,164,525.

BACKGROUND OF THE INVENTION AND PRIOR ART STATEMENT

This invention relates to a carburetor for suppling a fuel/air mixture to an internal combustion engine. More particularly, this invention relates to an improved device for injecting a fuel/air mixture into the intake manifold of an internal combustion engine.

The prior art discloses in a number of instances, the injection of fuel into the intake manifold or similar air intake conduit of an internal combustion engine. The prior art also discloses fuel injectors of numerous different constructions. Exemplary of such prior art, from all of which the present invention is patentably distinguishable, are the following U.S. patents.

U.S. Pat. Nos. 1,869,821, 1,931,541, 1,995,601, 2,089,989, 2,910,057 and 4,026,259 all disclose fuel supply devices for internal combustion engines in which the fuel is injected into an intake manifold or similar air supply conduit. Moreover, in some instances, a valve for controlling the air supply and means for controlling the flow rate through the fuel injection means are controlled by a common linkage from the throttle of the motor vehicle in which the internal combustion engine is installed. However, the fuel injection means in each instance are notably different from the device of the present invention which will hereinafter be described.

U.S. Pat. Nos. 3,702,175 and 3,982,694 are representative of the great diversity of constructions of fuel injection nozzles disclosed in the prior art. However, prior art fuel injection nozzles, such as those of these two patents, are notably different from the device of the present invention as will hereafter be described.

It is an object of the invention to provide a carburetor for supplying a fuel/air mixture to an internal combustion engine which increases the power of the combustion engine.

It is another object of the invention to provide a carburetor for supplying a fuel/air mixture to an internal combustion engine which results in higher gas mileage and a lower level of pollutants in the exhaust gases than a conventional carburetor or fuel injection system.

It is a further object of the invention to provide a carburetor for supplying a fuel/air mixture to an internal combustion engine which can serve as a replacement for a conventional carburetor without otherwise substantially altering the engine.

It is a still further object of the invention to provide a carburetor for supplying a fuel/air mixture to an internal combustion engine which is substantially simpler and less expensive than conventional carburetors and fuel injection systems.

Other objects and advantages of the invention will be apparent from the following description of the invention.

BRIEF DESCRIPTION OF THE INVENTION

In accordance with the invention, there is provided a carburetor for supplying a fuel/air mixture to an internal combustion engine. The carburetor comprises fuel regulation means for controlling the flow rate of the fuel in response to a motor vehicle throttle and continuously feeding the fuel to the intake manifold of the engine, air admitting means for admitting air with the ejected fuel into the intake manifold, and fuel/air admixing means including a plurality of blades rotating by suction force due to the operation of the engine, whereby the fuel and air passing through the fuel regulation means and the air admitting means, respectively, are atomizingly admixed and are fed to the engine through the intake manifold. The fuel regulation means and the air admitting means are situated in a housing and the fuel/air admixing means is rotationally provided below the housing. Preferably, the fuel/air admixing means is a turbine.

The fuel regulation means comprises a shell, a tube received in the shell and a rod received in the tube with a sliding fit, a plurality of orifices in the tube at intervals along at least a portion of the length of the tube, the rod being insertable in the tube to an extent sufficient to block the orifices and retractable to an extent sufficient to leave the orifices unobstructed, the number of orifices left unobstructed increasing in proportion to the extent to which the rod is retracted, the rod including means for connection to a linkage from the motor vehicle throttle for effecting axial movement of the rod, an annular space defined between the exterior wall of the portion of the length of the tube having orifices and the portion of the length of the interior wall of the shell facing the orifices, and means defining passages for admitting liquid fuel into the annular space. Consequently, when the rod is inserted in the tube to an extent sufficient to block the orifices the fuel is ejected from the fuel regulation means solely through the annular space, and when the rod is retracted to an extent sufficient to leave the orifices unobstructed some of the fuel also passes from the annular space through the orifices to the interior of the tube from whence the fuel is ejected. The volumetric flow rate of the fuel into and through the tube increases as the number of orifices left unobstructed is increased by increasing the retraction of the rod.

The air admitting means includes means defining a passage for the air and a valve for controlling passage of the air through the air passage. There is also provided a common linkage to the valve and the rod for simultaneously opening the valve and retracting the rod and simultaneously closing the valve and inserting the rod, the linkage including means for connection to the motor vehicle throttle.

In practice, the carburetor is intended to be used on the intake manifold of the engine, in the same position as a conventional one, for supplying fuel/air mixture to the intake manifold.

DETAILED DESCRIPTION OF A PREFERRED EMBODIMENT

The combination apparatus shown in FIGS. 1–4 is fundamentally a combination of a fuel regulation means 10, air admitting means 11 and fuel/air admixing means 12, the fuel regulation means 10 and the air admitting means 11 being simultaneously controlled by a common linkage 13. The linkage 13 is "common" in the sense that it is shared by the fuel regulation means 10 and air admitting means 11.

Figure 2:
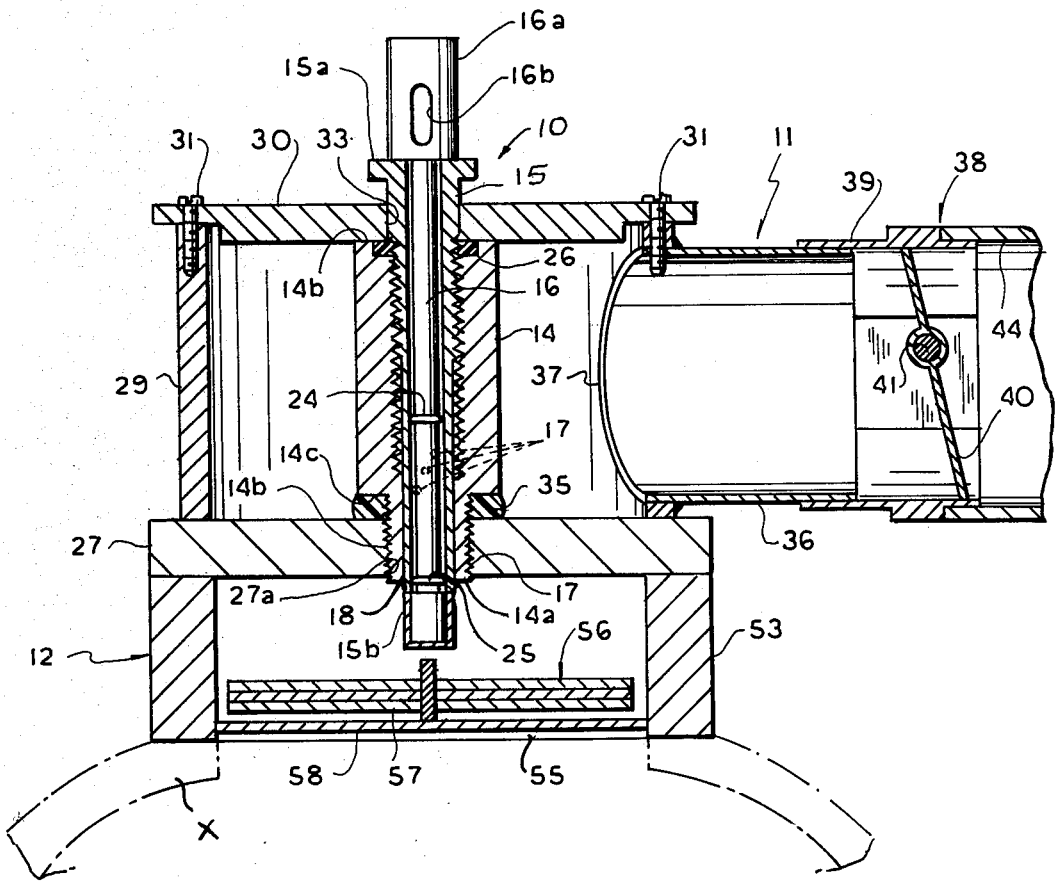
FIG. 2 is a cross section taken on section line 2—2 of FIG. 1, but with the carburetor installed on an intake manifold shown in phantom.
Figure 3:
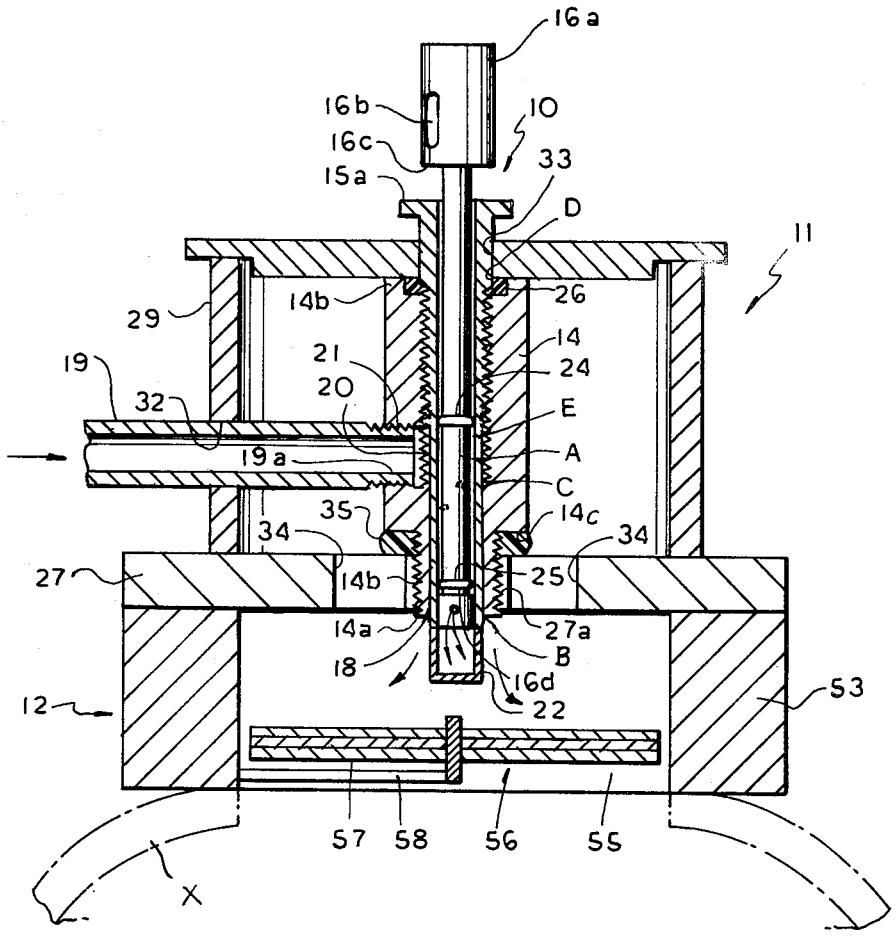
FIG. 3 is a cross section taken on section line 3—3 of FIG. 1, but with the carburetor installed on an intake manifold shown in phantom.

The fuel regulation means 10 includes a shell 14, a tube 15 received in the shell 14 and a rod 16 received in the tube 15 with a sliding fit. A plurality of orifices 17 is provided in the tube 15 at intervals along at least a portion of the length of the tube 15. In particular, the orifices are in a helical array of 360° extending from level A to level B of the tube 15. The rod 16 includes means **16*a* for connection to a linkage from a motor vehicle throttle. In particular, the connection means 16*a* is an upper portion of the rod 16 of enlarged diameter in which there is provided a slot 16*b* for receiving an end of a lever of the linkage. The lower part of the means 16*a* also provides a shoulder 16*c* for abutting against the upper end 15*a* of the tube 15 thereby to limit downward sliding of the rod 16 into the tube 15. With reference to FIG. 2, it is seen that when the shoulder 16*c* of the rod 16 is abutting against the upper end 15*a* of the tube 15, the lower end 16*d* of the rod 16 and the lower end 15*b* of the tube 15 meet. It is also seen in FIG. 2 that with the rod 16 thus fully inserted in the tube 15, the rod 16 is blocking all the orifices 17 in the tube 15. With reference to FIG. 3, it is seen that as the rod 16 is progressively retracted from the tube 15, and in particular as the lower end 16*d* of the rod 16 rises above level B of the tube 15, first the lowermost of the orifices 17 at level B and then, in addition, orifices at higher levels are, one by one, left unobstructed. Hence, the number of orifices 17 left unobstructed increases in proportion to the extent to which the rod 16** is retracted.

Figure 4:
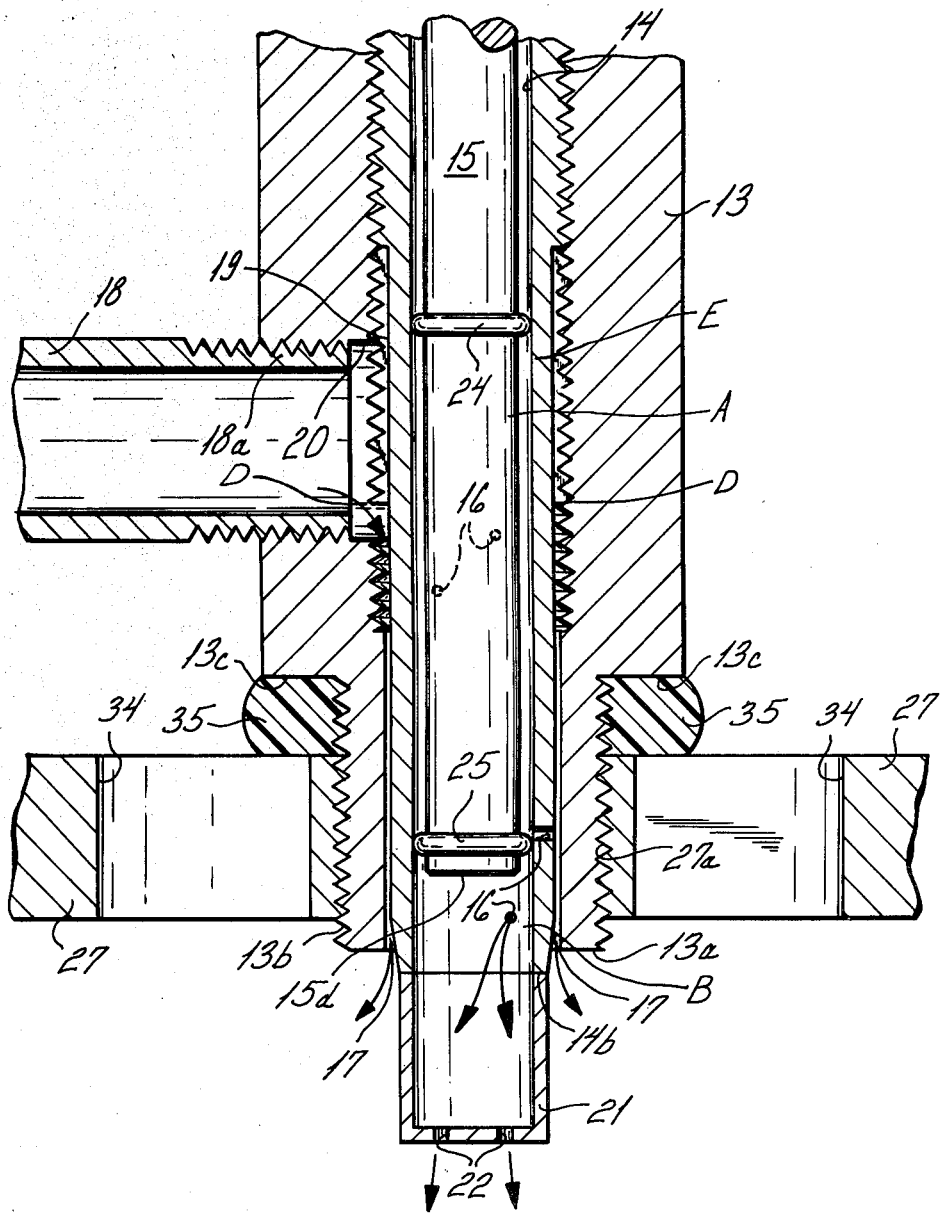
FIG. 4 is an enlargement of a portion of FIG. 3.
Figure 5:
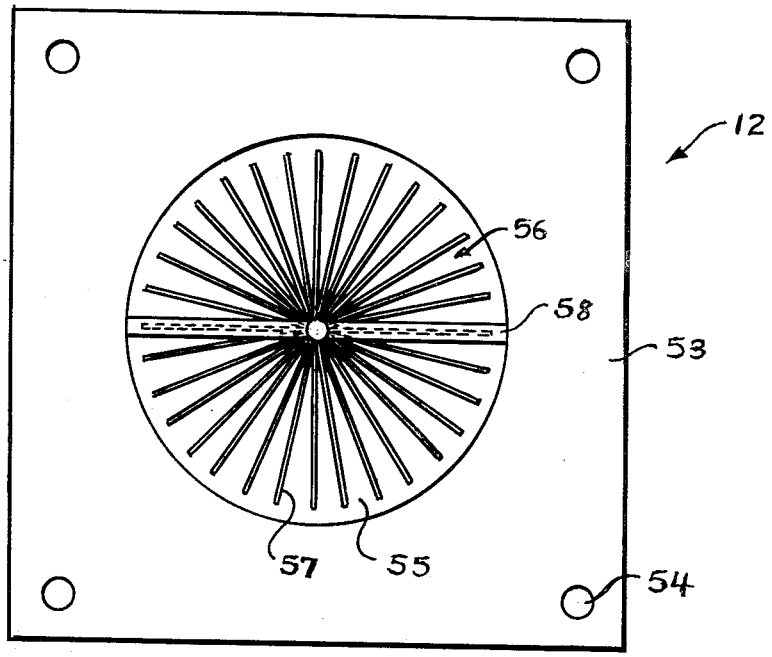
FIG. 5 is a plan view of the fuel/air admixing means according to the invention.

An annular space 18, which is clearly shown in FIG. 4, is defined between the exterior wall of the portion C to B of the length of the tube 15 having orifices 17 and the portion of the length of the interior wall of the shell 14 facing the orifices 17. The annular space 18 is merely the result of the external diameter of the tube 15 being slightly smaller than the internal diameter of the shell 14. Also provided are means 19 and 20 defining passages for admitting liquid fuel into the annular space 18. In particular, the means 19 is a fuel supply line, and the means 20 is a flat milled onto the surface of the tube 15. The tube 15 is externally threaded and the shell 14 is internally threaded from level C to level D. Thus, the tube 15 is screwed into the shell 14. A radial bore 21 is provided through a wall of the shell 14. The radial bore 21 is internally threaded. An end portion **19*a* of the fuel supply line 19 is externally threaded. Consequently, the fuel supply line 19 is screwed into the bore 21. The flat 20 extends from level E, i.e., approximately at the top of the internal diameter of the fuel supply line 19 to level C, i.e., the lower end of the threads. Thus, the flat 20 communicates between the fuel supply line 19 and the annular space 18, which extends from level C to the level of the lower end 14*a* of the shell 14. In practice, a plurality, for example, four or five, identical flats 20 are provided around the circumference of the tube 15 to assure that one of these flats 20 is in alignment with the bore 21 regardless of the angular displacement of the tube 15 relative to the shell 14**.

From the foregoing, it can readily be seen that at all times the fuel is flowing through the fuel supply line 19, fuel will flow into the annular space 18 due to communication from the fuel supply line 19 to the annular space 18 by means of a flat 20. The fuel which flows through this path exits from the means 10 at the juncture of the tube 15 and the shell 14 at the lower end **14*a* of the shell 14** as a spray which is in a frustoconical configuration emanating from the aforesaid juncture. This takes care of the fuel requirements of the engine when idling.

As the driver depresses the throttle, through a mechanical linkage which will hereinafter be described, axial movement is imparted to the rod 16 which retracts the rod 16 from the tube 15. Hence, a progressively increasing number of orifices 17 is left unobstructed. The orifices 17 communicate between the annular space 18 and the interior of the tube 15. Hence, some of the fuel also flows through the orifices 17 into the interior of the tube 15. Fastended onto the lower end **15*b* of the tube 15 is a spray cap 22 having orifices 23. The fuel which flows to the lower end 15*b* of the tube 15 enters the spray cap 22 and exits the cap through the orifices 23 in the form of a spray. All the while, fuel continues to be sprayed in the other mode, too. The further the rod 16 is retracted, the greater the rate at which fuel is supplied to the engine and, consequently, the more the vehicle accelerates. The rod is provided with a pair of O-rings 24 and 25 seated in respective annular grooves in the rod 16. When the rod 16 is fully inserted in the tube 15, the O-ring 24 is slightly above the highest orifice 17 and the O-ring 25 is slightly below the lowest orifice 17. When the rod 16 is retracted to the maximum extent effected by the linkage from the throttle, the O-ring 25 is in about the same position as the O-ring 24 was in when the rod 16 was fully inserted in the tube 15. The O-rings 24 and 25, hence, prevent fuel vapors from seeping upwardly out of the fuel regulation means 10. To this same end, an O-ring 26 is provided in an annular recess provided in the upper end 14*b* of the shell 14. The interior surfaces of the O-ring 26 are in contact with the outer face of the tube 15 and, hence, the O-ring 26 prevents the seepage of fuel fumes upwardly out of the means 10 through the interface of the internal threads of the shell 14 and the external threads of the tube 15**.

The fuel regulation means 10 and air admitting means 11 are mounted in a housing which constitutes part of the air admitting means. The housing includes a base plate 27 having a hole 28 bored through each of its corners for mounting together with the fuel/air admitting means 12 onto the top of an intake manifold X in the same manner as a conventional carburetor, which the present invention replaces. The housing is further constituted of a cylindrical side wall member 29 and a disc-shaped cover 30. The cover 30 is releasably held onto the cylindrical side wall member 29 by means of four screws 31. The fuel supply line 19 passes through a bore 32 provided in the cylindrical side wall member 29. The tube 15 passes through a bore 33 provided through the center of the cover 30. The O-ring 26, which seals off the escape of fuel from the interface of the internal threads of the shell 14 and the external threads of the tube 15, also prevents the escape of fuel vapors through the interface of the bore 33 and the upper portion of the tube 15. The lower portion of the shell 14 is provided with external threads **14*b*. The base plate 27 is provided with openings 34 communicating between the interior of the housing of the carburetor according to the invention and the interior of the intake manifold X through the admixing means 12. Through the remaining central area 27***a* of the base plate 27 is provided an internally threaded bore into which the externally threaded lower end of the shell 14 is screwed. An O-ring 35 is provided at the shoulder 14*c* of the shell 14 situated immediately above the threaded portion of the shell 14. The O-ring 35 is also in contact with the base plate 27 and seals off the interface of the external threads 14*b* of the shell 14 and the internal threads provided in the bore through the central portion 27*a* of the base plate 27. An air inlet conduit 36 communicates with the interior of the housing through an opening 37 in the side wall member 29. Communicating with the air inlet conduit 36 for controlling the flow of air therethrough is a butterfly valve assembly 38. The butterfly valve assembly comprises a section of conduit 39 in which a butterfly valve 40 is mounted on a pivot pin 41 which is received in journal bearings 42, 43 on the walls of the conduit section 39. Additional air inlet conduit 44 may be provided on the upstream side of the butterfly valve assembly 38. The conduit 44 may communicate with a conventional automotive air filter at the location of which air first enters the air intake system of the motor vehicle.

Figure 1:
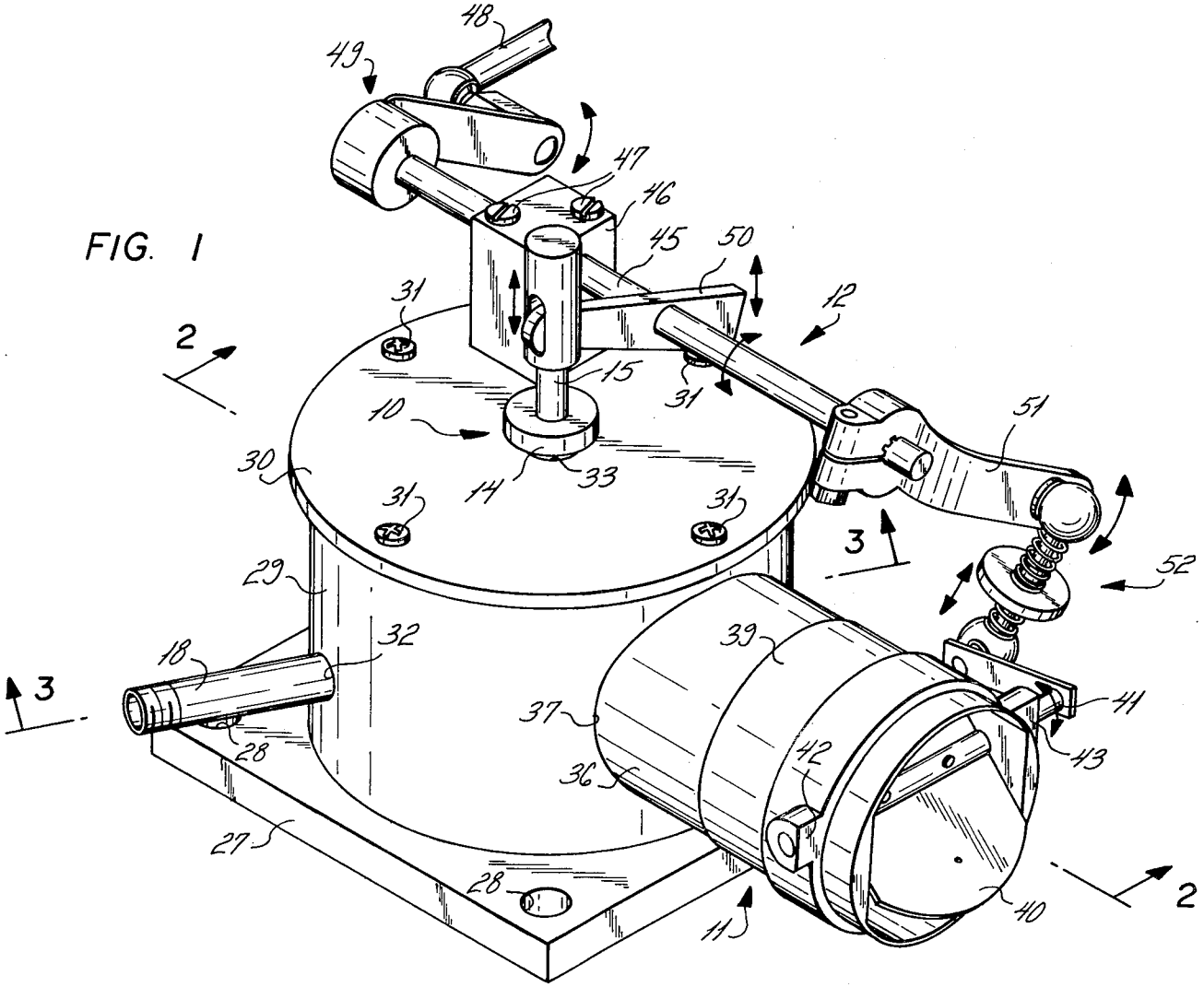
FIG. 1 is a perspective view of a carburetor according to the invention for taking the place of a conventional carburetor.

The linkage 13 includes a shaft 45 which is journalled in a block 46 fastended to the cover 30 by means of screws 47. A rod 48 extends from the throttle (not illustrated) to a crank assembly 49 connected to one end of the shaft 45. Fastened to the shaft 45 at an intermediate point is a lever 50. The lever 50 engages the rod 16 by being received in the slot 16*b* in the rod 16. To the other end of the shaft 45 is connected a lever 51 which, in turn, is pivotally connected to a crank assembly 52 which it actuates. With reference to FIG. 1, it is seen that pushing the rod 48 toward the crank assembly 49 by means of depressing the throttle causes the crank assembly to angularly displace in the clockwise direction, thereby angularly displacing the shaft 45 in the clockwise direction, which causes the lever 50 to lift the rod 16 and causes the lever 51 and crank assembly 52 to open the butterfly valve 40 thereby to effect the simultaneous introduction of air and increased quantities of fuel into the intake manifold 23 through the admixing means 12, resulting in acceleration of the engine. As usual, the throttle is provided with a spring, so that when one takes one's foot off the throttle, the rod 48 will move away from the crank assembly 49, thereby causing the lever 50 to push the rod 16 down again and the lever 51 and crank assembly 52 thereby to close the butterfly valve 40 again, resulting in deceleration of the engine.

The fuel/air admixing means 12 is situated below the housing of the fuel regulation means 10 and air admitting means 11 and is connected to the intake manifold X together with the means 10 and 11. Specifically, the fuel/air admixing means 12 includes a plate 53 having holes 54 at each corner through which screws passing through the holes 28 of the base plate 27 pass for connection of the carburetor to the intake manifold X. In the center of the plate 53 an opening 55 is provided in which a turbine 56 having a plurality of blades 57 is rotationally supported by a rod 58 crossing the center of the opening 55. When the engine is operated, the fuel and air are drawn into the engine through the intake manifold. The turbine 56 is rotated by the suction force of the engine, so that fuel and air are atomizingly admixed before entering into the intake manifold X. Consequently, completely admixed fuel and air are supplied to the engine, whereby combustion efficiency of the engine is significantly improved. That is, the engine having the carburetor of the invention exhibits increased power and gas mileage as well as significantly lower levels of pollutants in the exhaust gases.

While the invention has been described by reference to a specific, preferred embodiment thereof, it is to be understood that modifications and variations thereof which would be obvious to one skilled in the art are intended to be encompassed within the scope of the hereto appended claims.

What is claimed is:

1. A carburetor for supplying a fuel/air mixture to an internal combustion engine having an intake manifold and equipped with a throttle, comprising fuel regulation means for controlling flow rate of the fuel in response to throttle movement and continuously feeding the fuel to the intake manifold, air admitting means for admitting air with the ejected fuel into the intake manifold, and fuel/air admixing means including a plurality of blades rotatable by suction resulting from operation of the engine, whereby the fuel and air passing through the fuel regulation means and the air admitting means respectively are atomizingly admixed and are fed to the engine through the intake manifold, said fuel regulation means comprising a shell, a tube received in the shell and a rod received in the tube with a sliding fit, a plurality of orifices in the tube at intervals along at least a portion of the length of the tube, the rod being insertable in the tube to an extent sufficient to block the orifices and retractable to an extent sufficient to leave the orifices unobstructed, the number of orifices left unobstructed increasing in proportion to the extent to which the rod is retracted, the rod including means for connection to a linkage from the throttle for effecting axial movement of the rod, an annular space defined between the exterior wall of the portion of the length of the tube having orifices and the portion of the length of the interior wall of the shell facing said orifices, and means defining passages for admitting liquid fuel into the annular space, whereby the fuel is ejected from the fuel regulation means solely through the annular space when the rod is inserted in the tube to an extent sufficient to block the orifices and some of the fuel also passes from the annular space through the orifices to the interior of the tube from whence the fuel is ejected when the rod is retracted to an extent sufficient to leave the orifices unobstructed, the volumetric flow rate of the fuel into and through the tube increasing as the number of orifices left unobstructed is increased by increasing the retraction of the rod.

2. A carburetor according to claim 1, in which said air admitting means includes means defining a passage for the air and a valve for controlling passage of the air through the air passage.

3. A carburetor according to claim 2, further comprising a common linkage to the valve and the rod for simultaneously opening the valve and retracting the rod and simultaneously closing the valve and inserting the rod, the linkage including means for connection to the throttle.

* * * * *